United States Patent [19]

Bone

[11] 4,395,640

[45] Jul. 26, 1983

[54] SPECIAL ELECTRIC CONVENIENCE OUTLET (SECO)

[76] Inventor: Keith A. Bone, 19315 Annalee Ave., Carson, Calif. 90746

[21] Appl. No.: 374,876

[22] Filed: May 4, 1982

[51] Int. Cl.[3] ..... H01H 19/14

[52] U.S. Cl. ..... 307/115; 220/3.9; 307/147

[58] Field of Search ..... 307/114, 115, 147; 220/3.9, 3.92

[56] References Cited

U.S. PATENT DOCUMENTS

| | | | |
|---|---|---|---|
| 366,124 | 7/1887 | McElroy | 307/114 |
| 529,532 | 11/1894 | Scribner | 315/361 |
| 1,683,742 | 9/1928 | Thomas, Jr. | 220/3.92 X |
| 2,675,465 | 4/1954 | Saelen | 240/73 |
| 2,979,624 | 4/1961 | Askerneese | 307/147 X |
| 3,135,469 | 6/1964 | Hanson | 362/85 |
| 3,200,244 | 8/1965 | Meyer | 240/73 |
| 3,461,349 | 8/1969 | Meyer | 317/120 |
| 3,534,319 | 10/1970 | Queirolo et al. | 339/24 |
| 3,814,833 | 6/1974 | Yamada et al. | 174/48 |
| 4,056,297 | 11/1977 | Gartung | 339/23 |
| 4,104,540 | 8/1978 | Lien | 307/114 |
| 4,109,231 | 8/1978 | Krouse | 307/114 X |
| 4,178,468 | 12/1979 | Jorgenson et al. | 174/48 |

*Primary Examiner*—Michael L. Gellner
*Assistant Examiner*—Derek S. Jennings
*Attorney, Agent, or Firm*—James F. Cottone

[57] ABSTRACT

An electricity distribution unit has a plurality of electrical outlets integrated into an adjustably-sized unitary assembly having means for switchably energizing selected ones of the outlets. Other outlets remain continuously energized, and integral optical recognition means distinguish between the two types. The assembly further includes specialized mounting means to facilitate secure mounting to suitable surfaces.

10 Claims, 5 Drawing Figures

SPECIAL ELECTRIC CONVENIENCE OUTLET (SECO)

BACKGROUND OF THE INVENTION

1. Field of the Invention

The present invention relates generally to home electrical outlets remote from a wall outlet and particularly to an electricity distribution unit having a plurality of duplex receptacles powered from a single outlet. Specifically, the invention discloses a special electric convenience outlet unit which includes the particular combination of both normally energized outlet for powering appliances requiring constant power and switch controlled outlets for selectively energizing appliances.

2. Description of the Prior Art

The prior art includes numerous devices and methods for distributing electricity in the home to locations remote from permanently installed, conventional wall outlets. Over the years, through methods ranging from the simple extension cord to the relatively recent RF and ultrasonic remote control units, prior art devices have attempted to simplify the connection to and controllable switching "ON" and "OFF" of electrical appliances such as lamps, radios, televisions, etc.

Representative of the prior art is U.S. Pat. No. 2,979,624 to Askerneese which reveals a multiple outlet, controllable electrical extension device having means for independently switching a plurality of electrical appliances from a remote location.

A somewhat more complicated electrical outlet and lighting assembly is shown in U.S. Pat. No. 3,135,469 to Hanson. In Hanson, a rigid, preassembled device is disclosed which provides both lighting and electrical outlets to a work area, including provisions for selectively energizing various groupings of the outlets.

A still further prior art teaching is revealed in U.S. Pat. No. 3,461,349 to Meyer which includes a console having switched electrical outlets, oxygen outlets, etc., for use in a hospital room.

SUMMARY OF THE INVENTION

A controlled electricity distribution unit includes a conduit member having adjustable mounting means at proximal and distal ends thereof, a first plurality of electrical outlets distributively positioned at the proximal and distal ends of the conduit member, a second plurality of electrical outlets distributively positioned adjacent the proximal and distal ends of the conduit member, switching means distributively positioned near the proximal and distal ends of said conduit member, the switching means including first and second switches electrically connected to each other and circuit means having an input line adapted to be connected to a source of external power and three separate circuits including; a first circuit connecting a first part of the input line to all of the plurality of outlets, a second circuit connecting a second part of the input line to the first plurality of outlets to establish a first unique electrical operating condition for the first plurality of outlets, and a third circuit connecting the second part of the input line to the second plurality of outlets via the first and second switches to establish a second unique electrical operating condition for the second plurality of outlets controlled by the first and second switches.

It is therefore a primary object of the present invention to provide improved apparatus for distributing electricity in the home or workshop.

An object of the invention is to provide a simple, convenient electricity distribution unit having both constant voltage outlets and switched voltage outlets which can be used in the home.

Another object of the invention is to provide an economical, multiple appliance switching unit which can be safely used in the home without the need for any home rewiring.

A still further object of the invention is to provide an economical electrical distribution unit which can be assembled from readily available materials by unskilled labor.

A feature of the invention is that the electricity distribution unit can be conveniently installed on and used in conjunction with a domestic or institutional bed to selectively control lights and radios and also to provide continuous power to devices, such as clocks, electric blankets, and other appliances which require it.

Another feature of the invention is that the electricity distribution unit is adjustable to permit mounting of the unit on a variety of bed sizes.

A further feature of the invention is that the electricity distribution unit can be used in a home workshop area to provide a group of constant power outlets for trigger control devices such as drills and saws, and also to provide switch controlled outlets for devices such as lamps and fans.

Other objects and features of the invention will be apparent from the following description of the preferred embodiments taken in conjunction with the accompanying drawings.

DESCRIPTION OF THE PREFERRED EMBODIMENT

Figure 1:
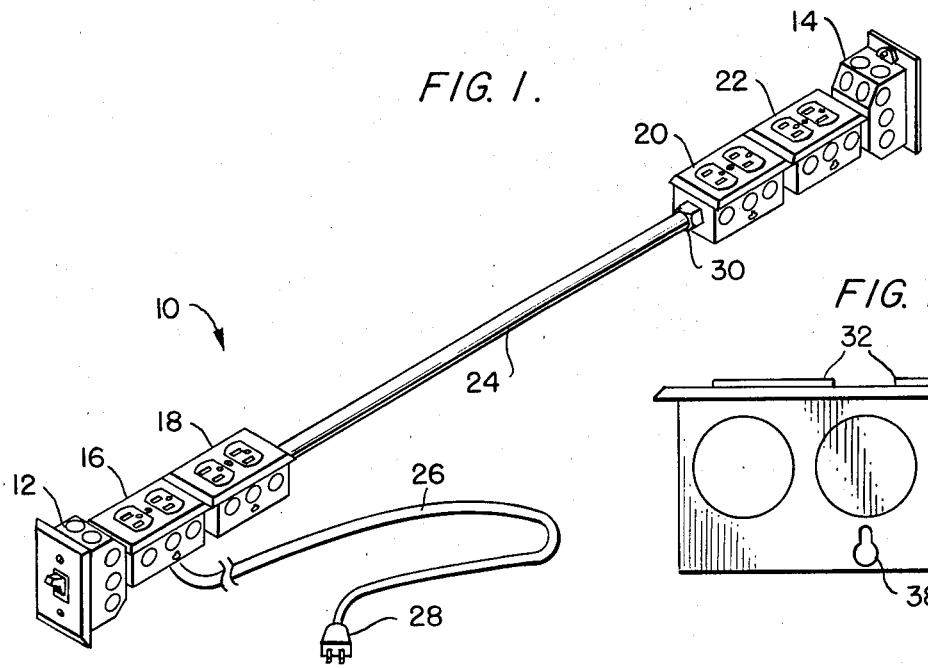
FIG. 1 is a perspective view of an electricity distribution unit according to the present invention.

As illustrated in FIG. 1, an electricity distribution unit, designated generally as 10, includes a pair of multiple position switch boxes 12 and 14 and four duplex receptacle boxes 16, 18, 20 and 22. The unit 10 further includes a voltage source input line 26 terminated with a standard male power plug 28 and a conduit member 24 interconnecting the receptacle boxes 18 and 22.

Each of the switch boxes 12 and 14 houses a conventional "three-way" switch, which may be of the single pole, double throw variety. As will be explained in detail in reference to FIG. 2, the pair of switches control the flow of electricity to the duplex receptacle boxes 18 and 20.

Each of the duplex receptacle boxes 16, 18, 20 and 22 may be formed from conventional rough-in boxes having circular apertures at each longitudinal end. The apertures allow wiring from the switch boxes 12 and 14 and from the source input line 26 to pass through the length of the unit, supplying power to each of the receptacle boxes 16, 18, 20 and 22. The conduit 24 is preferably one-half inch EMT tubing and is connected to the boxes 18 and 22 by a pair of one-half inch pressure couplings 30 only one of which is shown in FIG. 1. The receptacle boxes 18 and 16 are also attached by means of a conduit and pressure couplings (not shown), as are the receptacle box 16 and the switch box 12. An identical arrangement interconnects the receptacle boxes 20 and 22, and the switch box 14. Alternatively, the various boxes at each end of the unit 10 could be welded together or otherwise affixed in order to make the unit 10 more permanent and sturdy.

The use of the pressure couplings 30 to connect the two ends of the conduit 24 to the two boxes 18 and 20 allows the unit 10 to be adjustable in length and thus adaptable for use with bed headboards of various widths. This is accomplished by loosening the couplings 30 and sliding the conduit 24 into or out of the boxes 18 and 20. For example, a typical queen size headboard varies in width from 58 to 64 inches. With the queen size style of unit 10 having a maximum width of 64 inches it would be necessary to shorten the length of the unit 10 to fit a headboard 58 inches long. So by releasing the couplings 30 and sliding the proximate end of the conduit 24 into the box 18 three inches and sliding the distal end of the conduit 24 into the box 20 three inches, six inches can be removed from the total length of the unit 10.

Figure 1A:
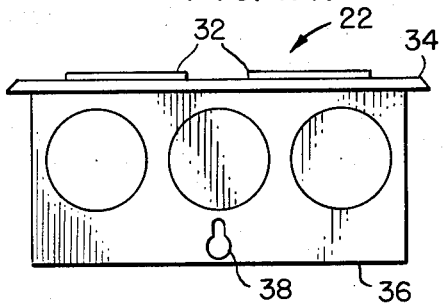
FIG. 1A is a side view of a receptacle box of FIG. 1.

Referring now to FIG. 1A, a side view of the receptacle box 22 of FIG. 1 is shown. It is understood that the description of the receptacle box 22 is also applicable to each of the other boxes 16, 18 and 20 inasmuch as all of the boxes 16, 18, 20 and 22 are essentially identical in structure. The box 22 includes a pair of three-prong outlets 32, an outlet cover plate 34 and a "rough-in" box member 36. The outlets 32 are mounted in the "rough-in" box 36 in a conventional manner, i.e. by a pair of screws, (not shown) one at either end. Likewise the cover plate 34 is secured over the outlets 32 by a single screw (not shown) between the outlets 32 in a manner well known in the art. The cover plate 34 can be various colors and can carry indicia on the surface thereof. This variation in coloring is sown by shading in the drawing figures. In the preferred embodiment, some of the cover plates 34 will be one color and others will be a color distinguishable therefrom so that outlets having different operating characteristics can be easily distinguished from one another.

The "rough-in" box 36 includes a pair of mounting apertures 38, one in each side of the box 36, in the shape of an inverted keyhole. The aperture 38 shown in FIG. 1A is drilled in the box member 36 directly opposite an identical aperture (not shown) on the opposite side of the box member 36. In a preferred embodiment, the aperture 38 is drilled to one quarter inch across at its narrow portion and three-eigths inch at the wide portion. This allows a screw having a three-sixteenths shank and a five-sixteenths head to be inserted through the wide portion of the aperture 38 by a #1 phillips screwdriver.

The unit 10 can be attached to a wooden headboard by first adjusting the length of the unit 10 to coincide with the width of the headboard as discussed above, and positioning the unit 10 at a desired height on the headboard. Prepositioned and partially inserted wood screws (not shown) can then be tightened by a screw driver inserted through the apertures 38 in the outer wall of the receptacle boxes 16, 18, 20 and 22. Once the wood screws are secure in the headboard, the unit 10 can be pushed downward, thus engaging the exposed shank of each of the screws in the narrow portion of the respective apertures 38. The screws can then be further tightened, causing the screw heads to engage the box member 36 adjacent the narrow portions of the apertures 38 and thus tightly secure the unit in place. In the event that it is desired to attach the unit to a brass bed, nylon straps or other suitable loop straps may be used.

In a preferred embodiment, the unit 10 can be used to control electrical devices located around a bed in a home. In this usage, the unit 10, or one of like configuration can be attached behind the headboard of the bed with the outlets facing upward, and a switch positioned at either end of the headboard. The receptacle boxes 16 and 22 would provide constant power for appliances such as clocks, radios, electric blankets, and the like while the receptacle boxes 18 and 20 could be turned "ON" and "OFF" responsive to the switches in boxes 12 and 14. The switch controlled receptacle boxes 18 and 20 can be utilized for powering bedside lamps, reading lights and other applances which a person may want, for instance, to turn "OFF" at bedtime or turn "ON" in the middle of the night, without having to fumble for a lamp switch.

Electrical power for the unit 10 is provided through the input line 26 which can be plugged into a conventional wall socket via the plug 28. The use of only one input line 26 to supply voltage to a plurality of receptacle boxes such as 16, 18, 20 and 22 eliminates the potentially unsafe condition of multiple extension cords haphazardly positioned on the floor. While the plug 28 is shown as a two prong device, it is clear that a three prong plug (illustratively of the "U-ground" type) may also be used to conform with the various electrical codes in use. The minor wiring additions this requires are largely associated with a separate ground conductor distributed throughout the distribution units. In the interests of a clearer exposition of the present invention, this grounding will not be detailed, as it is largely well known and conventional.

Figure 2:
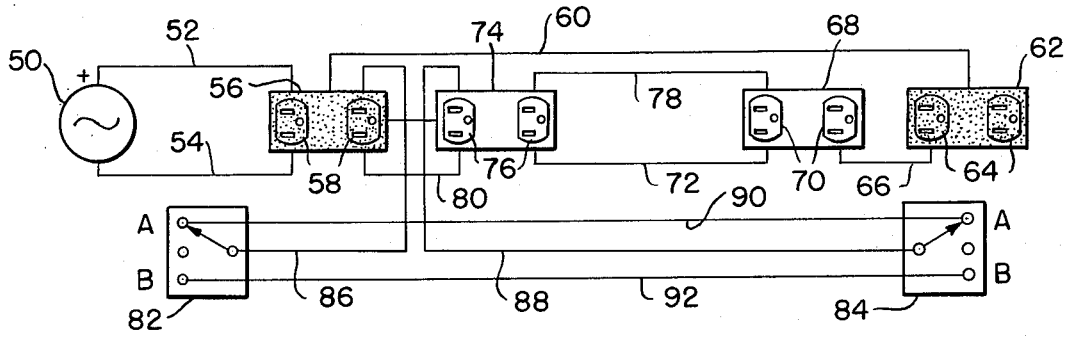
FIG. 2 is a simplified electrical schematic diagram of the circuitry of the unit of FIG. 1.

Referring now to FIG. 2, a simplified pictorial schematic of the electricity distribution unit 10 of FIG. 1 is shown. A source of electrical power 50 illustratively 60 hertz AC) which is supplied from an existing conventional home wall outlet, is connected to a pair of input lines 52 and 54 which supply conventional 115 VAC, 60 Hz. power to the unit 10. The AC voltage on lines 52 and 54, which could be housed within a sleeve to form the input line 26 of FIG. 1, is supplied to a duplex receptacle 56 having a pair of three-prong outlets 58. The electrical connections within the duplex receptacles of the preferred embodiments are of conventional form. For example, a first bus bar interconnects the top slot of each of the outlets 58, thus making them electrically equal. A second bus bar interconnects the bottom slot of each outlet 58, thus making those also electrically equal. By connecting a line to one of the bus bars, the voltage thereon can be "tapped" and routed to another location.

In view of the above and again with reference to FIG. 2, the input lines 52 and 54 are connected respectively to the top and bottom bus bars of the duplex receptacle 56 such that the outlets 58 will always be energized or "ON" in the presence of voltage at the source 50. A line 60 interconnects the top bus bar of the receptacle 56 with the top bus bar of a duplex receptacle 62 having a pair of outlets 64. It can be seen that the top bus bar of the receptacle 62 is electrically equal to the input line 52. The bottom bus bar of the receptacle 62 is connected via line 66 to the bottom bus bar of a duplex receptacle 68 having a pair of outlets 70. The bottom bus bar of the receptacle 68 is further connected to the bottom bus bar of a duplex receptacle 74 having a pair of outlets 76 via line 72. Likewise, the top bus bar of the receptacle 68 is connected to the top bus bar of the fourth receptacle 74 via line 78. The receptacles 68 and 74 are thus connected electrically in parallel through the interconnections of the lines 72 and 78. A line 80 interconnects the bottom bus bar of the receptacle 74 and the receptacle 56. The duplex receptacles 56, 62, 68 and 74 are housed in the "rough-in" boxes 16, 22, 20 and 18 respectively, of FIG. 1.

It can thus be seen that the receptacles 56 and 62, will always be energized in the presence of power at the source 50 via the closed circuit formed through lines 52, 60, 66, 72, 80, and 54. Power to the receptacles 68 and 74 respectively, is controlled by the relative positions of a pair of single-pole, double throw switches 82 and 84. The moveable arm of the switch 82 is connected to the top bus bar of the first receptacle 56 via line 86. Likewise, the top bus bar of the receptacle 74 is connected to the moveable arm of switch 84 via line 88. Both of the switches 82 and 84 have two throw positions, designated as "A" and "B". The "A" and "B" positions on the two switches 82 and 84 are respectively interconnected by lines 90 and 92; the line 90 interconnecting the "A" throw positions, and the line 92 interconnecting the "B" throw positions.

As shown in FIG. 2, the switches 82 and 84 are both in the "A" throw position. In this configuration a closed circuit is formed via lines 52, 86, switch 82, line 90, switch 84, lines 88, 78, 72, 80 and 54, thus providing power to the receptacles 68 and 74. The same closed circuit is formed when both switches 82 and 84 are in the "B" position, with the line 92 substituted for the line 90. When the switches 82 and 84 are in opposite throw positions, for example with switch 82 in the "A" position and switch 84 in the "B" position, no voltage will be applied to the receptacles 68 and 74 and they will be in the "OFF" or deenergized state. It should be noted again that the switch positions have no effect on the receptacles 56 and 62 which are always energized in the presence of voltage at the source 50.

In operation, the electricity distribution unit 10 would be fastened in place, for instance behind the headboard of a bed or at a workbench, and power plug 28 (of FIG. 1) containing the lines 52 and 54 would be plugged into a wall electrical outlet. The duplex receptacles 56 and 62 would always be "ON" so that appliances in need of constant electricity, such as a clock, could use the outlets 58 and 62 as a source.

The controlled duplex receptacles 68 and 74 and their respective outlets 70 and 76 are dependent upon the position of switches 82 and 84 for their "ON" and "OFF" states. This allows for single switch control of appliances such as lamps, radios, etc., which a person may wish to turn on or off. The normally energized receptacles 56 and 62 are, in a preferred embodiment, covered with a faceplate having a first indicia thereon and the switched receptacles 68 and 70 are covered with a faceplate having a second, contrasting indicia. In this way, a user of the unit can, quickly and easily, visually determine which recptacles are switch controlled and which are energized. For example, the continuously energized receptacles 56 and 62 could be colored black, as shown by shading in FIG. 2, while the switchably energized receptacles 68 and 74 could be white.

While the switches 82 and 84 shown in the drawings and discussed herein are single-pole, double throw switches, it is understood that the switches may be of the rocker, rotary, pushbutton, etc. types and not depart from the scope of the invention.

Figure 3:
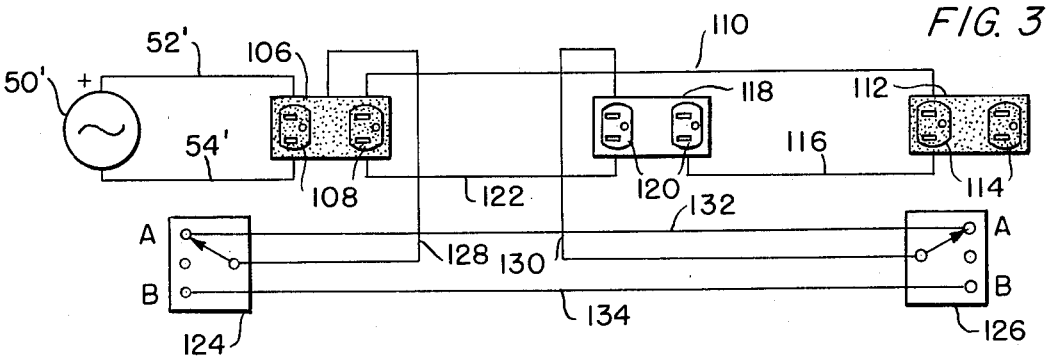
FIG. 3 is a simplified electrical schematic diagram of the circuitry of an alternate embodiment of the invention.

Referring now to FIG. 3, a simplified pictorial schematic of a second embodiment of an electricity distribution unit is shown. A power source 50', which is identical to the power source 50 of FIG. 2, is connected to a pair of input lines 52' and 54' connected to the top and bottom bus bars, respectively, of a duplex receptacle 106 having a pair of three prong outlets 108 therein. The lines 52' and 54' are connected directly to the receptacle 106 bus bars such that whenever the power source 50' is present, the outlets 108 are energized and can be used to power, for example, appliances or lamps. A line 110 connects the top bus bar of the receptacle 106 to the top bus bar of a duplex receptacle 112 which includes a pair of three-prong outlets 114. The receptacle 112 is connected to a duplex receptacle 118 via line 116 which extends between the bottom bus bar of the receptacle 112 and the bottom bus bar of the receptacle 118. The receptacle 118 also includes a pair of threeprong outlets 120. The bottom bus bar of the receptacle 118 is further connected to the bottom bus bar of the receptacle 106. It can thus be seen that a closed circuit is formed from the source 50' through the receptacles 106 and 112 respectively, along the path defined by lines 52', 110, 116, 122, and 54'. Accordingly, in the presence of power at the source 50', the outlets 108 and 114 will always be in the "ON" state, i.e. able to supply power to electric lamps and the like.

The state of the outlets 120 of the receptacle 118 is controlled by the relative positions of a pair of single-pole, double-throw switches 124 and 126. The pole of switch 124 is connected to the top bus bar of the receptacle 106 via line 128. Likewise, the pole of switch 126 is connected to the top bus bar of receptacle 118 via line 130. Both of the switches 124 and 126 have two throw positions, designated as "A" and "B". The "A" and "B" positions on the two switches 124 and 126 are interconnected by lines 132 and 134 respectively.

As shown in FIG. 3, both switches are in the "A" position, thus closing the circuit which includes the receptacle 118. The closed circuit is formed by lines 52', 128, switch 124, line 132, switch 126, lines 130, 122, and 54'. The same closed circuit is formed when both switches 124 and 126 are in the "B" position with the exception of line 134 being in place of line 132. If the switches 124 and 126 are in opposite throw positions, for example if the switch 124 is in the "A" position and the switch 126 is in the "B" position, there would be a gap in the circuit supplying power to the outlets 120 of the receptacle 118 and the receptacle 118 would be in the "OFF" or deenergized state.

Figure 4:
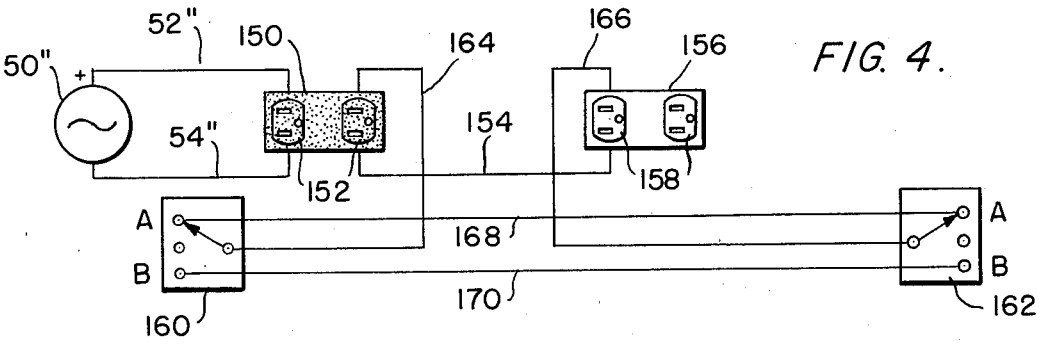
FIG. 4 is a simplified electrical schematic diagram of the circuitry of yet another alternate embodiment of the invention.
Figure 2:
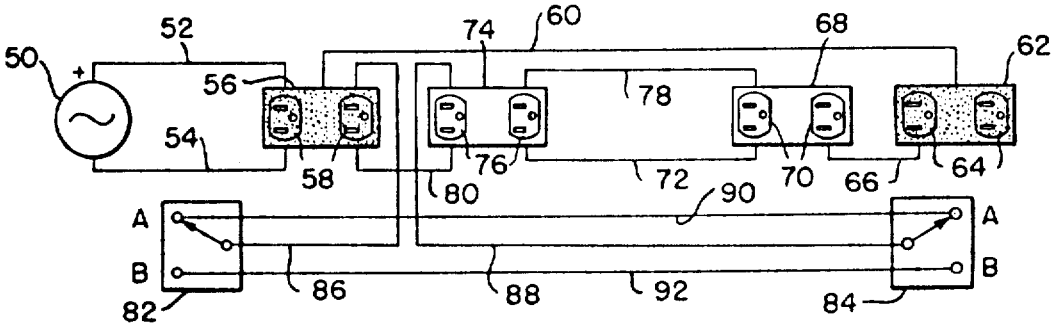
Figure 3:
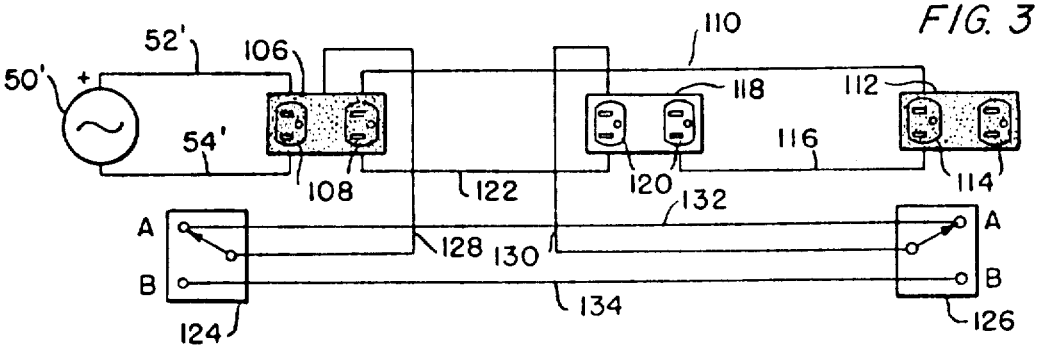
Figure 4:
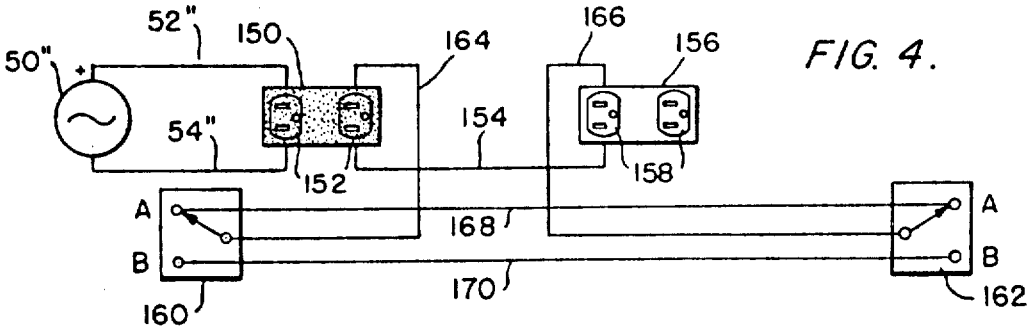

With reference to FIG. 4, a further embodiment of the electricity distribution unit is shown in a simplified pictorial schematic. A power source 50'', identical to the power source of FIG. 2, has pair of input lines 52'' and 54'' connected to the top and bottom bus bars respectively of a duplex receptacle 150 having a pair of three-prong outlets 152. The direct connection of the input lines 52'' and 54'' insures that whenever power is present at the source 50'', the outlets 152 are energized and able to power appliances. A line 154 interconnects the bottom bus bar of the receptacle 150 with the bottom bus bar of a duplex receptacle 156 having a pair of outlets 158.

The supply of power to the outlets 158 of the receptacle 156 is controlled by a pair of "three-way" switches 160 and 162. As shown in FIG. 4, the switches 160 and 162 are of the single-pole, double-throw variety. However, as described in reference to FIG. 2, other types of switches may also be suitable. The pole of switch 160 is connected to the top bus bar of the receptacle 150 via line 164. Likewise, the pole of switch 162 is connected via line 166 to the top bus bar of the receptacle 156. Both of the switches 160 and 162 have two throw positions, designated as "A" and "B". The two "A" positions and the two "B" positions on the switches 160 and 162 are interconnected by lines 168 and 170 respectively.

As shown in FIG. 4, the switches 160 and 162 are in the "A" position, thus forming a closed circuit through the receptacle 156 and supplying power to the outlets 158 when the source 50'' is present. The closed circuit is formed through lines 52'', 164, switch 160, line 168, switch 162, lines 166, 154 and 54''. The same closed circuit is formed when both switches 160 and 162 are on the "B" position except for the substitution of the line 170 for the line 168. If the switches 160 and 162 are in opposite throw positions, no voltage will be applied to the receptacle 156 and the outlets 158 will be in the "OFF" state, i.e. deenergized.

While the preferred embodiments have been directed to the use of the electricity distribution unit in the bedroom of a home, it should be understood that the unit 10 has equal applicability in a home workshop, a kitchen or numerous other locations.

The electricity distribution unit of the preferred embodiments is a portable unit which provides convenient control for bedside appliances. The different colors indicate which of the receptacles are normally energized and which are switch controlled, thus adding to the convenient nature of the invention.

Since many modifications, variations and changes in detail may be made to the present invention, all matter contained in the foregoing description or shown in the accompanying drawings is to be interpreted as illustrative and not in a limiting sense.

What is claimed is:

1. A controlled electricity distribution unit comprising:

(a) a conduit member having adjustable mounting means at proximal and distal ends thereof;

(b) a first plurality of electrical outlets distributively positioned at the proximal and distal ends of said conduit member;

(c) a second plurality of electrical outlets distributively positioned adjacent said proximal and distal ends of said conduit member;

(d) switching means distributively positioned near the proximal and distal ends of said conduit member, said switching means including first and second switches electrically connected to each other; and (e) circuit means having an input line adapted to be connected to a source of external power and three separate circuits comprising:

(i) a first circuit connecting a first part of said input line to all of said plurality of outlets;

(ii) a second circuit connecting a second part of said input line to said first plurality of outlets to establish a first unique electrical operating condition for said first plurality of outlets; and (iii) a third circuit connecting said second part of said input line to said second plurality of outlets via said first and second switches to establish a second unique electrical operating condition for said second plurality of outlets controlled by said first and second switches.

2. The controlled electricity distribution unit of claim 1 wherein said first plurality of outlets has a first optical indicia thereon and said second plurality of outlets has a second optical indicia thereon, said first indicia being visually distinctive from said second indicia.

3. The controlled electricity distribution unit of claim 1 wherein said first and second plurality of electrical outlets are mounted in a plurality of boxes.

4. The controlled electricity distribution unit of claim 3 wherein said boxes have a pair of keyhole-shaped apertures in opposite sides of said box.

5. The electricity distribution unit of claim 1 wherein said second plurality of outlets are adjustably connected to said conduit member.

6. The electricity distribution unit of claim 5 wherein said outlets are connected to the conduit by pressure couplings.

7. The electricity distribution unit of claim 1 wherein said first and second switches are of the single-pole, double-throw type.

8. The electricity distribution unit of claim 1 wherein the three circuits are all confined in part within the conduit member.

9. The electricity distribution unit of claim 1 wherein the input line terminates in a male plug.

10. The electricity distribution unit of claim 1 wherein:

said first plurality of outlets includes four, three-prong outlets;

said second plurality of outlets includes four, three-prong outlets; and said first and second switches are of the single-pole, double-trow type.

* * * * *

UNITED STATES PATENT AND TRADEMARK OFFICE

CERTIFICATE OF CORRECTION

PATENT NO. : 4,395,640

DATED : July 26, 1983

INVENTOR(S) : Keith A. Bone

It is certified that error appears in the above-identified patent and that said Letters Patent is hereby corrected as shown below:

Figures 2, 3 and 4 of the drawings should appear as shown on the attached sheet.

Col. 2, line 57, "22" should read -- 20 --.

Col. 3, line 4, "22" should read -- 20 --.

Signed and Sealed this

*Third* Day of *April 1984*

[SEAL]

*Attest:*

GERALD J. MOSSINGHOFF

*Attesting Officer*

*Commissioner of Patents and Trademarks*